US005538328A

United States Patent [19]

Lewis, Jr.

[11] Patent Number: 5,538,328

[45] Date of Patent: Jul. 23, 1996

[54] METHOD OF FUSING FILAMENT TO A SPONGE

[75] Inventor: John C. Lewis, Jr., Salisbury, Vt.

[73] Assignee: Tucel Industries, Inc., Forest Dale, Vt.

[21] Appl. No.: 435,769

[22] Filed: May 5, 1995

Related U.S. Application Data

[63] Continuation-in-part of Ser. No. 137,537, Oct. 18, 1993.

[51] Int. Cl.[6] ..... A46D 1/08; A46D 3/00

[52] U.S. Cl. ..... 300/21; 300/5

[58] Field of Search ..... 300/21, 3, 5, 8

[56] References Cited

U.S. PATENT DOCUMENTS

| | | | |
|---|---|---|---|
| Re. 27,455 | 8/1972 | Lewis, Jr. | 300/21 X |
| 2,666,954 | 1/1954 | Potter | 300/21 |
| 3,471,202 | 10/1969 | Lewis, Jr. . | |
| 3,641,610 | 2/1972 | Lewis, Jr. | 15/114 |
| 3,910,637 | 10/1975 | Lewis, Jr. . | |
| 4,009,910 | 3/1977 | Lewis, Jr. . | |
| 4,109,965 | 8/1978 | Lewis, Jr. . | |
| 4,221,833 | 9/1980 | Guillermin et al. . | |
| 4,291,431 | 9/1981 | Lewis, Jr. . | |
| 4,310,377 | 1/1982 | Lorenz . | |
| 4,637,660 | 1/1987 | Weihrauch | 300/21 |
| 4,908,902 | 3/1990 | McNab et al. . | |
| 4,978,242 | 12/1990 | Konose . | |
| 4,988,146 | 1/1991 | Weihrauch . | |
| 5,058,233 | 10/1991 | Davis, III | 15/244.1 |
| 5,224,763 | 7/1993 | Dirksing | 300/21 |

*Primary Examiner*—John Husar
*Attorney, Agent, or Firm*—Donald C. Casey

[57] ABSTRACT

The improved method of fusing synthetic monofilament tufts to synthetic sponge material is disclosed whereby the filament tufts are set into a container-like molded base component which allows for greater support within the flexible cellular structure of conventional cellulose and polyurethane spongeware compositions thus resulting in greater resistance to tuft removal.

7 Claims, 4 Drawing Sheets

METHOD OF FUSING FILAMENT TO A SPONGE

This application is a continuation-in-part of application Ser. No. 08/137,537 filed on Oct. 18, 1993, the disclosure of which is hereby incorporated by reference.

BACKGROUND OF THE INVENTION

1. Field of the Invention

The invention relates to the improved manufacturing of fused spongeware scrub products that are comprised only of synthetic monofilament tufts attached to synthetic cellular sponge material; wherein there is a fused bond between the tufts and sponge material of sufficient strength to keep the tufts attached during vigorous use.

2. Description of the Prior Art

Many different methods for manufacturing scrub brushes have been devised in the past, including gluing, stapling and fusing tufts to a base. Even though many years ago, a tufted sponge was patented, there has been no commercial acceptance of that product due to the fact that the fused end portion of the tuft could never be made to adhere to the sponge substrate during vigorous use. When the sponge was used, the fused tufts would readily fall away or pull out. U.S. Pat. No. 3,641,610 issued to John C. Lewis, Jr. discloses such a tufted sponge product. It is readily apparent in the structure described in that patent that the bottom of the fused filament mass which is attached to the sponge material is insufficient in surface area. Approximately only the bottom surface of each fused tuft is attached to sponge material and the sponge material merely pulls away from the fused tuft end during scrubbing.

SUMMARY OF THE INVENTION

The instant invention overcomes the inadequacies in the prior art by providing an enlarged, cup-like, tuft base section made from fused filament with tuft working ends extending therefrom. The entire tuft base portion is fused to the surface of an internal opening in the sponge, resulting in at least two times more fused surface area in contact with and bonded to the sponge surface to thereby obtain an attached fused tuft that will not fall away from the sponge substrate during scrubbing.

The method of making the improved spongeware of this invention generally includes forming insertion openings of specific design, which are formed by removal of sponge material from a sponge block. The openings are then used to receive the prefused tuft end base sections.

DEFINITIONS

The term "spongeware" as used hereinafter includes any device, either a brush or wipe, having both synthetic filament tuft(s) molded base and a non-grid cellular support.

The term "sponge" substrate means any porous, wetable cellular type of material such as cellulose, polyurethane, polyolefins and the like.

The term "synthetic" filament as used hereinafter includes filaments which are formed from linear thermoplastic polymers from the group consisting of polystyrene and polystyrene co-polymers, polyvinyl chloride and polyvinylchloride-acetate co-polymers, polyethylene, polypropylene, polyethylene-polypropylene co-polymers, polyamides, polyesters and polyurethane. Both oriented and unoriented filament may be employed. Also, various filament cross-section may be imparted, such as for instance, i.e. circular, lobular, trifoil, X, and Y cross-sections, triangular, polygonal, star, etc. Mixtures of synthetic filaments may be employed in cases where the compositions of the filament are compatible during any fusing operations, i.e. heat sealing. Such filaments may have suitable crimp imparted to their length or a portion thereof. Filaments may contain organic or inorganic modifications in order to make them biodegradable, or subject to decomposition during or after use.

The term "picking" as used in this specification refers to the formation of filament tufts wherein two or more tufts are formed simultaneously by longitudinally engaging more than one cut-to-length filament at its ends and removing said filament from a parallel disposed bundle of filaments. The picking devices employed are those types which are disclosed in U.S. Pat. Nos. 3,471,202, 3,910,637, 4,009,910 and 4,109,965 all issued to Lewis, among others. The disclosures of these patents are hereby incorporated by reference.

It is therefore an object of this invention to provide new and useful tufted sponge cleaning tools.

It is another object to provide a fused tufted sponge having improved cleaning qualities by placing synthetic filament tuft ends at the surface of the wiping portion of said sponge in order to scrub the surface during the wiping operation whereby a simultaneously cleaning and wiping action takes place.

A further object of this invention is to provide a cleaning device of fused tuft configurations which lay flat on a cleaning surface.

An additional object of the invention is to provide a liquid carrying substrate for scrubbing tufts to deploy during scrubbing in order to help loosen dirt and debris.

Another object is to provide a flat planned integral one piece fused filament/sponge cleaning device and/or brushware device where the resulting filament working ends exert continued surface contact as well as extra pressure during use, which is self supporting, and which can be hand held or machine driven during use.

Still another object of this invention is to provide novel, durable brush constructions employing fused tufted sponges. These and other objects will become apparent with reference to the drawings and following description wherein:

DETAILED DESCRIPTION OF THE INVENTION

Figure 1:
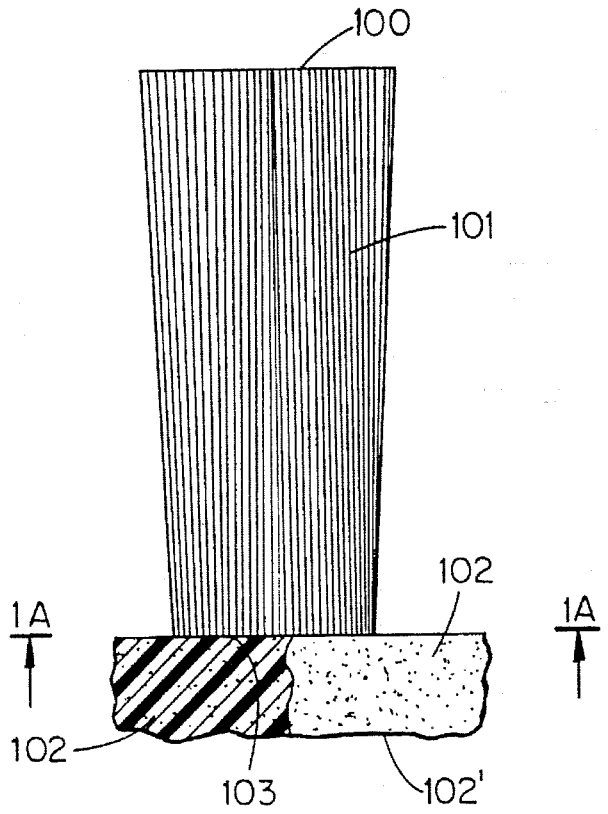
FIG. 1 (PRIOR ART)
FIG. 1 is a side view of any conventional synthetic filament fused tuft with base support.

Referring to FIG. 1, there is illustrated a conventional fused polypropylene filament tuft 100 having individual filaments 101 fused at their base 101' creating the support means 102 for holding or attaching said tuft to a portion of sponge. The filaments are first assembled, and their non-working ends 101' melted (fused) together thus forming the base 102.

Figure 2:
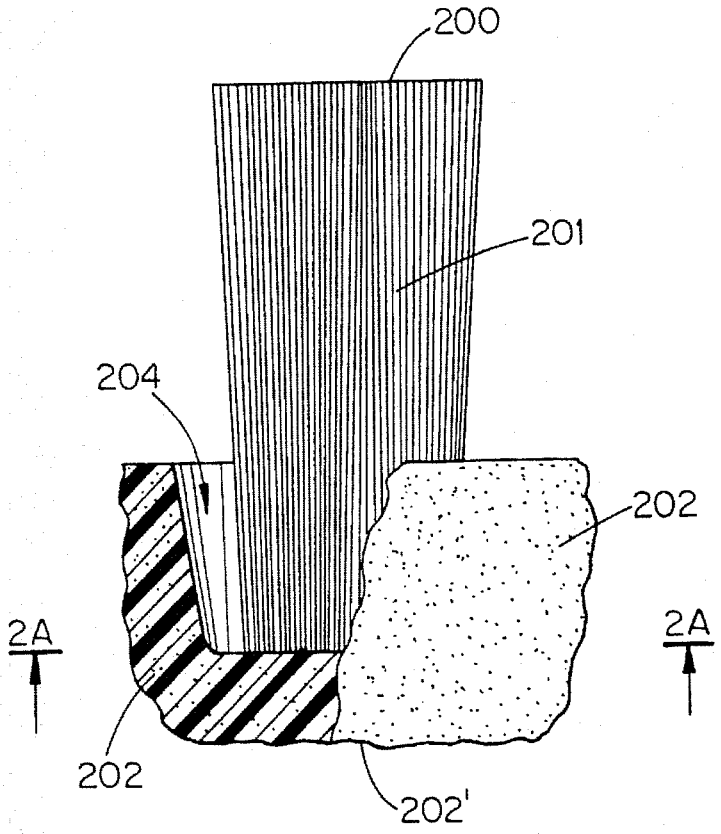
FIG. 2 is a side view of the synthetic fused filament tuft of the instant invention with an enlarged base support.

FIG. 2 illustrates the new and improved fused polypropylene filament tuft 200 of this invention having individual filaments 201 fused at their base creating the support 202 for holding or attaching said tuft to a portion of sponge. The filaments are first assembled, and their non-working ends melted (fused) together thus forming the base 202, in the same manner as the conventional formed tuft of FIG. 1. However, during the process of melting (fusing) additional filament material is melted thus creating a larger fused mass prior to affixing the fused portion to a substrate. When the molten mass of melted filament ends is inserted or affixed to a cellular substrate then there is created more than twice the surface area of the contact between the base and cellular material, thereby allowing for greater surface contact land lamination of the plastic filament melt 202 to the sponge.

Figure 3:
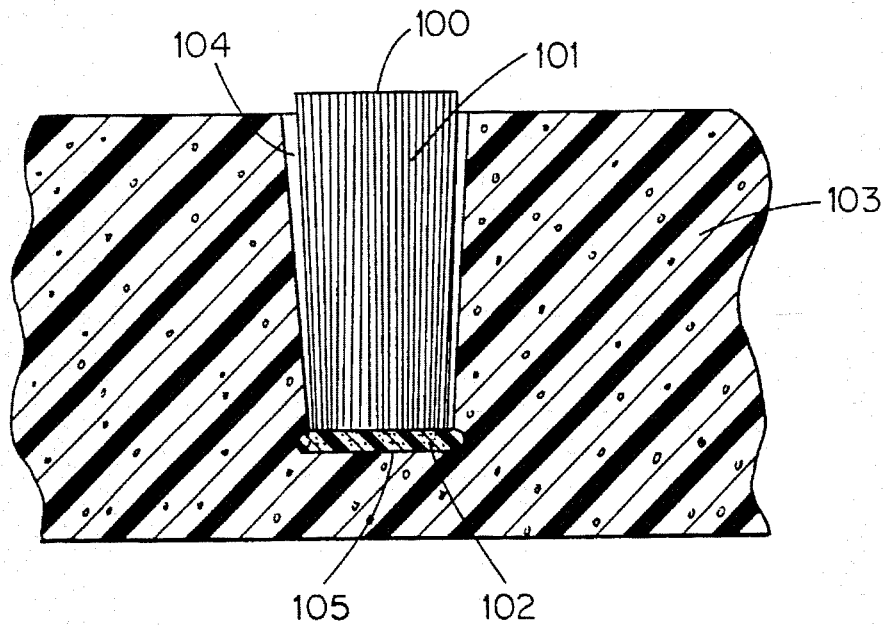
FIG. 3 (PRIOR ART)
FIG. 3 is a sectional view of a fused, conventional synthetic filament tuft in a cellulose sponge illustrating the base attachment area.
Figure 4:
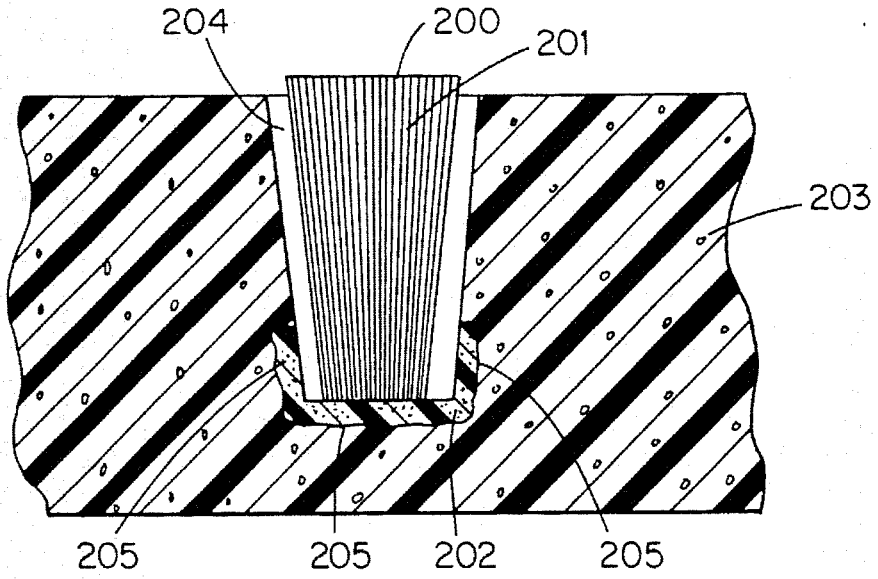
FIG. 4 is a sectional view of a fused, cup-like synthetic filament tuft in a cellulose sponge illustrating the base attachment area of this invention.

FIG. 3 illustrates the conventional fused tuft 101 as attached at the bottom of the fused portion 102 at 105 to a sponge 103. Thus the only tuft part affixed to the actual sponge material 103 is at 105. The space 104 along the radiating tuft filaments 101 extending from base portion 102 must be free to permit the tuft 101 to flex and move with the sponge material 103 during the cleaning and/or wiping process. Likewise, in FIG. 4 the improved fused tuft 201 is attached at the bottom and sides of the fused portion 202 to a sponge 203 according to this invention. Thus the additional fused portion 202 is affixed at the interface 205 to the actual sponge material 203. The space 204 along the radiating filaments 201 from base portion 202 leaves the tuft 201 free to flex and move with the sponge material 203 during the cleaning and/or wiping process as in the conventional fused tuft, however, there is a substantially greater bond between the filament base and the sponge.

Figure 1A:
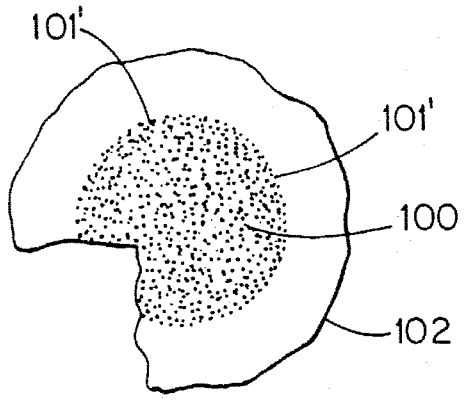
FIG. 1A (PRIOR ART)
FIG. 1A is a cross-sectional view of the synthetic fused filament tuft of FIG. 1 taken along line A—A.
Figure 2A:
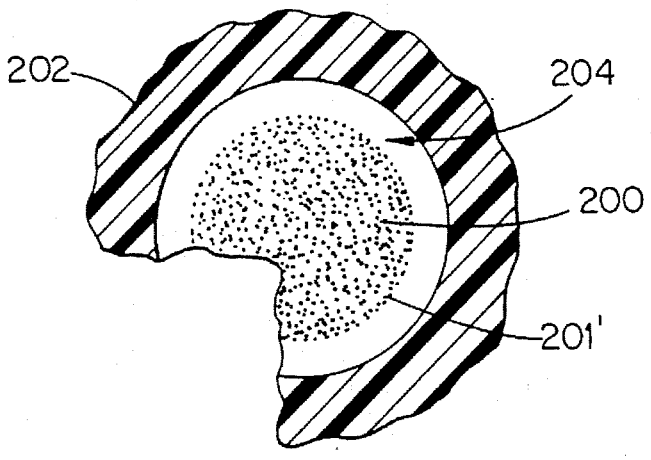
FIG. 2A is a side view of the synthetic fused filament tuft of FIG. 2 as taken along line B—B.

FIGS. 1A and 2A illustrate the differences in the fused surface contacting the sponge.

With reference to the conventional tuft 100 of FIG. 1A the melted non-working ends 101' of filament take the configuration of base 102 and the resultant area for attachment is the bottom surface area 102' having "x" diameter plus the area of the side of 102 having a height of "y". By giving "x" a diameter of 5 mm, the area of base section 102 is 78.5 sq. mm. By giving "y" a height of 1 mm, the area of the parameter 102 becomes 31.4 sq. mm or a total area of 109.0 sq. mm.

Comparing the melted non-working ends 201' of filament 201 of FIG. 2A the configuration of base 202 and the resultant area for attachment is calculated to be the bottom surface area 202' having "x" diameter plus the area of the side of 202' having a height of "z". By giving "x" a diameter of 5 mm, the area of base section 202' becomes 78.5 sq. min. By giving "z" a height of 5 mm, the area of the parameter 202' becomes 157 sq. mm. or a total contact area of 235.5 sq. mm as attached to the sponge material.

Figure 5:
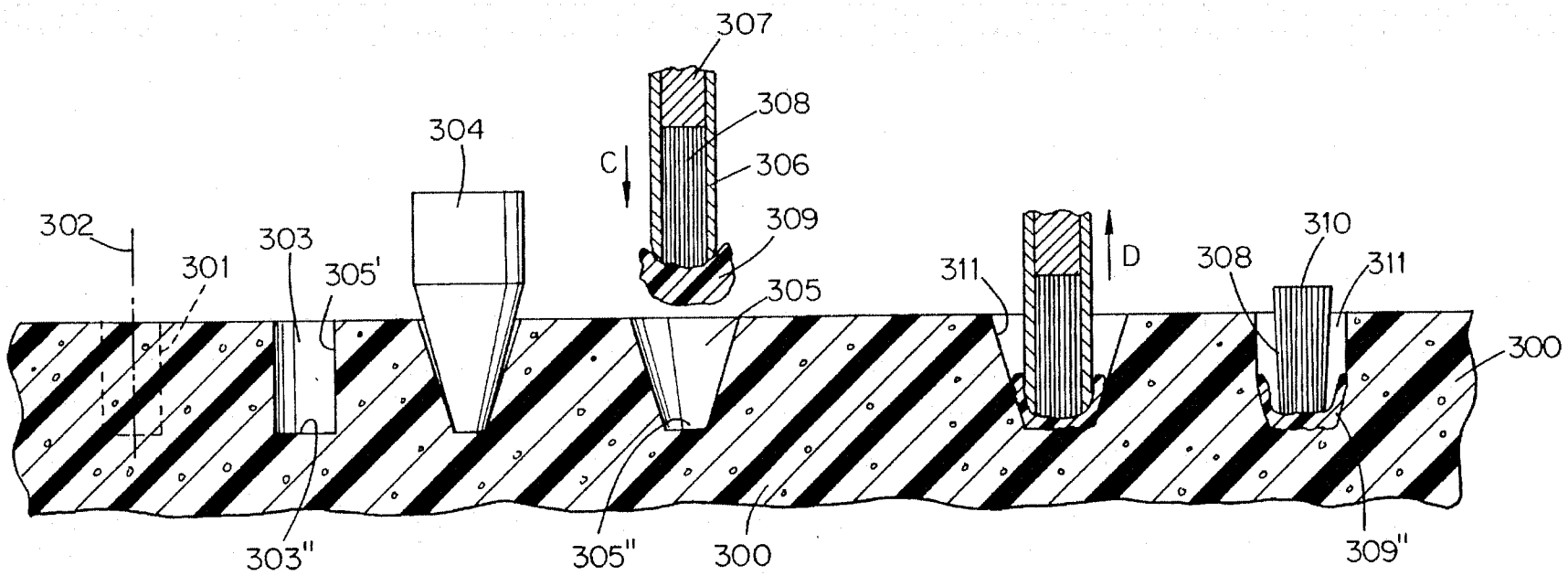
FIG. 5 is a sectional side view of a cellulose sponge illustrating a method employed for mounting the fused synthetic filament tuft therein.

An embodiment for fusing a filament tuft to sponge material is illustrated in FIG. 5. The method of this invention is described with reference to FIG. 5 as follows:

First, a center line 302 in the sponge material 300 is identified for the opening located at the dotted section 302.

Next, actual sponge material is removed as illustrated at 303, thus creating an opening with sides 303' and bottom section 303". The diameter of the bottom 303" should be no larger than the outside diameter of the filament picking means 306. After the hole area 303 is created, a preconfigured means 304 having capabilities of further opening the hole area 303, but not removing sponge material 300, is inserted into the opening 303 to force the walls 303' of the opening 303 further apart to create a tapered (frustro-conical) configuration 305' for the acceptance of the melted filament material during the insertion of the fused filament 309.

After the hole section 305 has been expanded, the premelted filament 308 with fused portion 309 and a movable working end trim means 307, in picking means 306 is inserted in direction "C" into opening 305. Picking means 306 continues to index in direction until the fused mass 309 comes into contact with the side walls 305' and bottom 305".

The fused filament mass 309 penetrates to open celled sponge surface 305' and then cools and solidifies in a few seconds, i.e. 3–4 seconds, and becomes attached to the sponge material 300 at the interface 309'. The picking means 306 is then indexed out of the opening 305 in direction "D".

Within a short period of time the sponge 300 returns to its original attitude and creates a space 311 between the filaments 308 of tuft 310 and the sponge 300. When comparing the fused tuft 100 of FIG. 3 to the fused tuft 310 of FIG. 5, it is apparent that the resultant tuft of this instant invention is superior in its ability to withstand the flexing and scrubbing action, and much more resistant to removal. The invention lies in the creation of the "cup-like" fused tuft section 309" formed by allowing for the melted mass of filament attached to the wall portion of the sponge to be much larger.

It should be noted also that section 209" adheres to the interface of the hole 305 and climbs the sides 305', leaving a space 311 between the tuft 310 and the section 309". This permits the tuft to flex during scrubbing action.

To reiterate, in the prior art embodiment of FIG. 3, the fused tuft end 102 is essentially a flat dish or plate. Before it cools, it only penetrates the adjacent open-celled sponge material. In contrast, as shown in FIG. 5, when the picking-element 306 indexes in the direction "C" the fused end 309 forms a cup-shape around the end of the picking element as it penetrates the adjacent sponge material. When the fused end cools and the picking element indexed in the direction "D", the cup-shaped base section 309" will provide a much greater bonded surface with the adjacent sponge material, and also the open area 311 surrounding the adjacent tuft, so that flexibility of the tuft 310 will not be lessened.

The invention in its broader aspects is not limited to the specific steps, methods, compositions, combinations and improvements described, but departures may be made therefrom in the scope of the accompanying claims without departing from the principles of the invention and without sacrificing its chief advantages. Instantaneously picking and fusing of all the filament tufts in one plane and in parallel filament arrangements into a sponge device can only be achieved by practicing the instant invention.

What is claimed:

1. Method for making a tufted sponge wherein the sponge is an open-celled synthetic material and said tufts are formed of synthetic cut-to-length filament comprising:

providing a sponge block having a plurality of openings in a surface thereof, each opening being formed by removal of a cylinder of said sponge material to a depth of about the length of said filament;

providing a stockbox containing a plurality of said filament disposed in a parallel relationship and providing at least one hollow picking element being substantially cylindrical and having an open end;

receiving a plurality of filament through the open end of said element to form a tuft thereof with an end portion thereof extending from the open end of said picker a distance greater than the diameter of said tuft;

heating said end portion of said tuft extending from said element until it consists entirely of fused filamentary material;

widening an opening in said sponge until it defines an upside down frustro-conical cavity;

inserting the fused end of said tuft and said element into the opening until the fused filamentary material forms a cup-like fused section around unfused filaments and said element penetrating the adjacent sponge surface; permitting said material to cool; and withdrawing said picking element from said tuft leaving said tuft in said opening retained by interconnection between the fused tuft material and sponge surface.

2. The method of claim 1 wherein the cup-like fused section has a base and sides and the height of said sides is at least equal to the diameter of said tuft.

3. The method of claim 1 wherein the end of said picking element forming said opening is retained within said opening in said sponge until said fused section has cooled.

4. The method of claim 3 wherein cup-like section is formed by fused tuft filament ends around the end of said picking element when said element and fused end portion are inserted into said sponge through the opening.

5. The method of claim 4 wherein the end of said tuft opposite said cup-like section is contained in a plane which contains the surface of said sponge.

6. The method of claim 1 wherein the length of fused filament material extending from said picking element is at least 5 millimeters.

7. The method of claim 1 wherein the diameter of said opening is about the diameter after widening is about that of said picking element.

* * * * *